United States Patent [19]

Kubiak

[11] 4,025,045

[45] May 24, 1977

[54] NOZZLE GUARD FOR AIRLESS SPRAY PISTOLS

[75] Inventor: John William Kubiak, Minnetonka, Minn.

[73] Assignee: Spray Tech Corporation, Minneapolis, Minn.

[22] Filed: July 21, 1975

[21] Appl. No.: 597,662

[52] U.S. Cl. ..... 239/288.5; 239/599; 239/600

[51] Int. Cl.[2] ..... B05B 1/04; B05B 1/28

[58] Field of Search ..... 239/288–288.5, 239/499, 504, 507, 508, 521, 522, 525–528, 596, 597, 599–601, 498; 302/64

[56] References Cited

UNITED STATES PATENTS

| | | | |
|---|---|---|---|
| 2,755,137 | 7/1956 | Hughf | 239/288.5 |
| 3,000,576 | 9/1961 | Levey et al. | 239/526 X |
| 3,190,564 | 6/1965 | Liedberg | 239/504 X |
| 3,464,740 | 9/1969 | Scruby et al. | 302/64 |
| 3,556,411 | 1/1971 | Nord et al. | 239/599 X |
| 3,599,876 | 8/1971 | Kyburg | 239/526 X |
| 3,952,955 | 4/1976 | Clements | 239/599 X |

*Primary Examiner*—Johnny D. Cherry
*Assistant Examiner*—Andres Kashnikow
*Attorney, Agent, or Firm*—Hill, Gross, Simpson, Van Santen, Steadman, Chiara & Simpson

[57] ABSTRACT

A nozzle guard for airless spray pistols including a generally cylindrical tubular guard member attached to the nozzle end of the pistol with the spray nozzle received interior thereof adjacent one axial end, the guard member projecting beyond the nozzle orifice a distance sufficient to prevent injection of human flesh by the paint spray from the orifice when the flesh is positioned at the terminus end of the guard member. The guard member is circumferentially discontinuous providing axial extending slots aligned with the peripheries of the major diameter of the spray pattern.

3 Claims, 4 Drawing Figures

Fig. 1
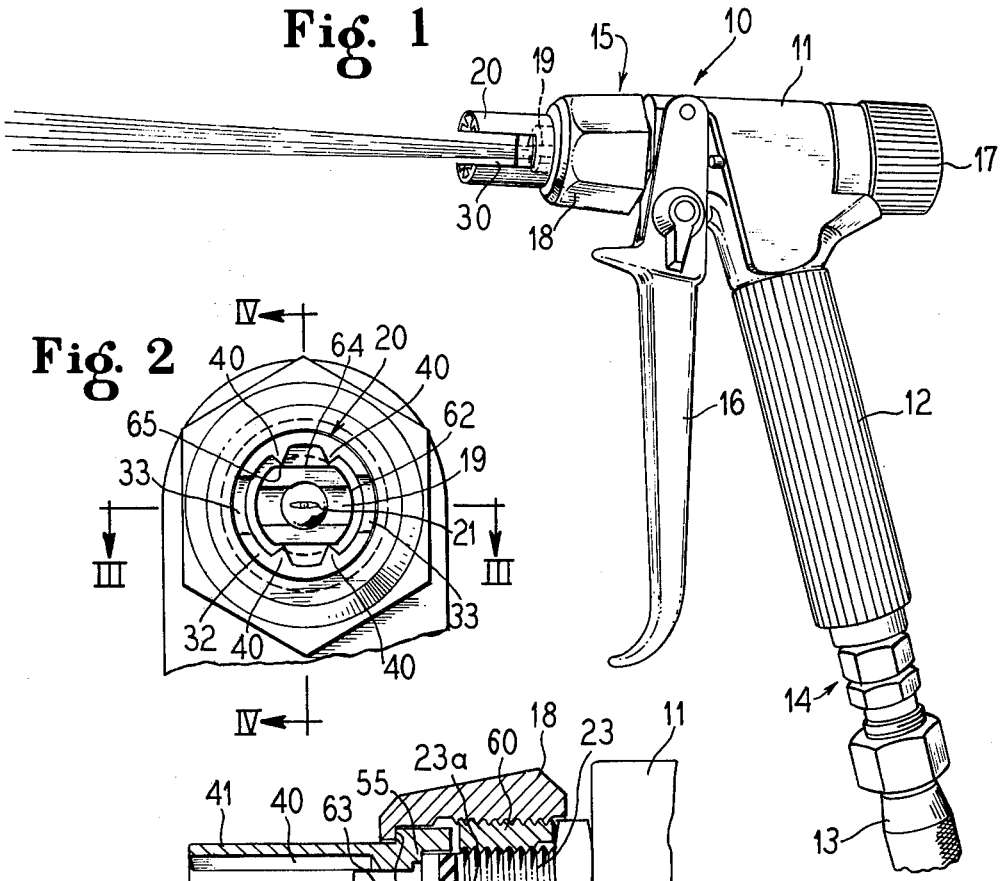
Fig. 2
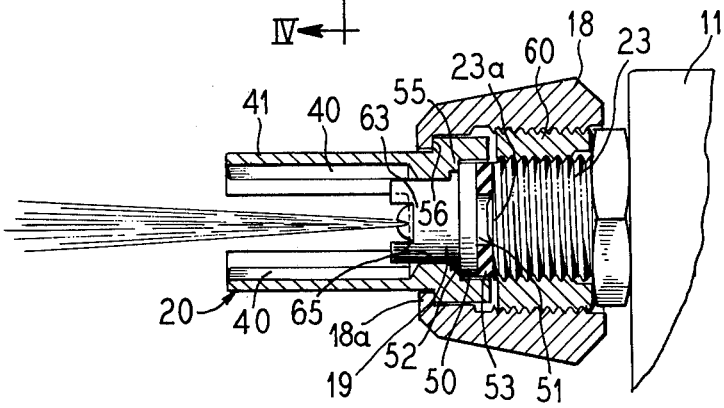
Fig. 3
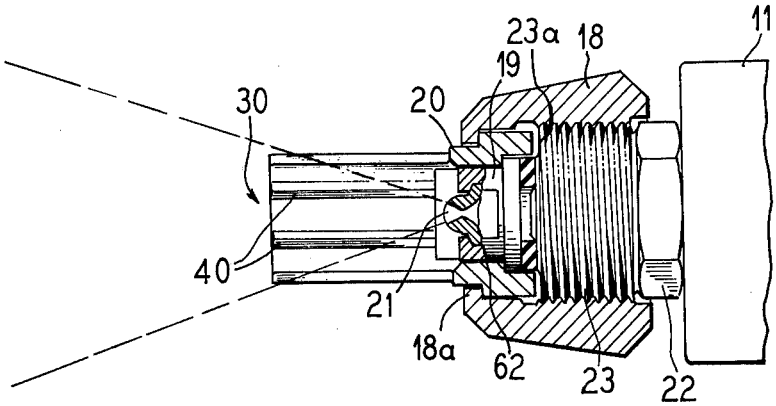
Fig. 4

NOZZLE GUARD FOR AIRLESS SPRAY PISTOLS

BACKGROUND OF THE INVENTION

1. Field of the Invention

This invention relates to paint spray equipment and more particularly relates to a safety tip guard for airless paint spray pistols.

2. Prior Art

Airless paint spray pistols having a pistol-like body member with pumped fluid passageways therethrough which terminate in a forwardly directed nozzle and which utilize a trigger controlled valve assembly for controlling passage of the pumped fluid to the nozzle are known to the art. Such spray pistols normallly have a nozzle tip attached at the discharged end by fastening means such as a tip nut with the tip projecting beyond the end of the tip nut. The tip terminates in an axial end face which has a nozzle orifice therethrough communicating to the internal passageway in the spray pistol body. In most instances the nozzle orifice is slot-like, or designed to produce a spray pattern downstream of the orifice which has an oval cross-section. Examples of such prior art spray pistols may be found in U.S. Pat. No. 3,743,188 issued July 3, 1973 to J. Wagner; U.S. Pat. No. 3,836,082 issued Sept. 17, 1974 to Krohn; U.S. Pat. No. 3,844,487 issued Oct. 29, 1974 to Malec and U.S. Pat. No. 2,969,296 issued Jan. 31, 1961 to Peeps. Such patents reflect, generally, standard types of prior art airless paint spray pistols.

Airless spray pistols all have one common feature. Because they are airless units, only paint or other pumped fluid exits the nozzle. In order to move the pumped fluid at a sufficient volume, extremely high pressures are utilized. In face, it has been known to use operating pressures between 3,300–3,600 pounds per square inch and theoretical maximum pressures on the order of 6,000 pounds per square inch have been envisioned although for normal nozzles sizes the usual operating pressure range is between 900 and 2900 p.s.i.. These pressures still exceed those found in prior art non-airless spray pistols.

Because such high pressures are used, the pressure-mass- velocity of the pumped fluid through the nozzle orifice is extremely high and the exiting stream can, in some instances, penetrate human flesh positioned closely adjacent the nozzle orifice. When such penetration occurs, the fluid injected through the flesh will spread out along the underlying muscle layer and, especially when the fluid is toxic, cause serious injury which, if not correctly treated can, at times, result in permanent injury.

Although it is known that such flesh penetration can occur immediatly adjacent the nozzle orifice, it is also known that this is a localized phenomenon and that, because of the spreading of the spray pattern and the mass-velocity decrease per area downstream of the nozzle, flesh injection will not occur at points remote from the nozzle opening.

It has therefore been suggested to provide a barrier which will project outwardly from the nozzle and which will prevent accidental positioning of human flesh within the area of the paint stream from the nozzle. While such barriers can be of aid in preventing accidental injury, they are ineffective against attempts to insert a human finger inwardly of the barrier in order to clean the interior of the barrier or to clean the nozzle orifice. In addition, it is important that a fool-proof protective device be provided which can not be tampered with in a manner which would eliminate its effectiveness without also preventing the spray pistol from working.

SUMMARY OF THE INVENTION

My invention provides an extended protective barrier or guard member for airless paint spray pistols which provides a partial guard around the area downstream of the nozzle orifice in which penetration of human flesh can occur. In addition, the guard member is affixed to the spray pistol and the spray tip in such a manner that removal of the guard member will prevent operation of the spray pistol. Additionally, I have dimensioned and designed the guard member in a manner which will prevent insertion of a human finger into the area those in which a sufficiently large portion of the fluid stream exits to cause flesh injection.

Further, I have designed the guard member in such a way that it will not interfere with the spray pattern from standard prior art non- circular orifices.

In its simplest illustrated embodiment, the guard member consists of cylindrical tube which is attachable to the spray pistol by a tip nut received around the guard member. The nozzle tip is received interiorly of the guard member and the guard member, tipped nut and tip are dimensioned such that the tip will not be retained on the end of the spray pistol by the tip nut absent the intervening positioning of the guard member.

Additionally, I provide a guard member having an inner area less than the normal dimensions of a human finger so that a finger cannot be inserted into the open end. In order to avoid interference with the spray pattern, the wall of the tubular guard member is circumferentially discontinuous providing axial slots. These slots are aligned with the nozzle orifice in such a manner that the peripheral portions of the major diameter of the spray pattern can project through the slots in those instances where the pattern major diameter exceeds the inner diameter of the guard member at a point spaced from the nozzle orifice less than the full axial length of the guard member. In order to maintain the alignment, means are provided preventing independent relative rotation between the guard member and the tip. Additionally, in order to allow the tip to be rotated to change the alignment of the spray pistol and the tip produced spray pattern, relative rotation between the guard member and the tip nut is allowed.

Further, because a number of spray pistols are presently on the market and in use without such protective guard members, I have provided a conversion assembly which will allow quick retro-fit of existing guns to equip them with the guard member of this invention in a manner which will still prevent use of the spray pistol without the guard member in place.

It is therefore an object of this invention to provide a flesh injection preventing guard member for airless spray pistols.

It is another more important object of this invention to provide a flesh injection preventing guard member for spray pistols which is attached to the spray pistol in a manner which prevents use of the spray pistol without the guard member.

It is another more particular object of this invention to provide a nozzle assembly for airless spray pistols wherein a nozzle tip is postioned interior of a guard member adjacent one end thereof and discharges into the interior of the guard member, the guard member having a length sufficient to prevent injection of human flesh, the guard member and tip attached, the spray pistol in a manner, which prevents attachment of the tip without the guard member and the tip and guard member being rotatable together independently of the spray pistol.

It is another more particular object of this invention to provide a spray tip for airless paint spray pistols wherein the spray tip includes a nozzle tip received interiorly of a nozzle guard which projects downstream of the spray tip a distance sufficient to prevent the injection of human flesh by the spray from the spray tip, the guard member having a circumferentially discontinuous wall portion providing axial slots through which peripheral portions of the major diameter of the spray pattern from the tip may extend, the guard member being dimensioned to prevent entrance of a human finger through the open end thereof and means for attaching the guard member and tip to a spray pistol in a manner which prevents operation of the spray pistol without the guard member.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE DRAWINGS

FIG. 1 is a perspective view of a spray pistol equipped with the nozzle guard of this invention.

FIG. 2 is a fragmentary end plan view of the pistol of FIG. 1 illustrating the nozzle and guard member.

FIG. 3 is a fragmentary cross-sectional view of an embodiment of the spray tip and nozzle assembly of this invention particulary adapted for use as a retro-fit assembly generally taken along lines IV—IV of FIG. 2.

FIG. 4 is a fragmentary cross-sectional view along lines III—III of FIG. 2 illustrating another embodiment of the spray tip and guard of this invention.

DESCRIPTION OF PREFERRED EMBODIMENTS

FIG. 1 illustrates a spray pistol 10 for airless spraying which includes a body portion 11 with a depending grip 12 which is attached to a pumped fluid conduit 13 through a swivel connection 1. The grip 12 and body portion 11 have internal fluid passageways communicating fluid from the conduit 13 to a nozzle dischrge end 15. An internally disposed valve is controlled by a trigger 16 to open and close the passageway. An adjusting member 17 allows adjustment of the degree of valve opening and provides for control of the spray. The nozzle discharge end 15 includes a tip nut 18, nozzle tip 19 and a guard member 20.

As best illustrated in FIG. 4, the body 11 may have a fitting 22 attached thereto which includes an externally threaded tubular member 23 which projects beyond member 11 and which is in internal communication with the passageways interior of the body. In standard prior art guns, the threaded portion 23 is engaged by a tip nut and a nozzle tip 19 is positioned between the end wall 23A of the threaded portion and an inturned lip 18A at the outer axial end of the tip nut. In this manner the tip 19 will be attached to the body 11 in communication with the internal passageways and fluid passing the valve controlled by the trigger 16 will be discharged through the orifice 21 of the nozzle tip 19.

As best illustrated in FIG. 2, nozzle tips for spray pistols such as illustrated have an orifice 21 which is non-circular and which produces a fanned pattern spray substantially in the manner of an elongated oval. A standard tip for such a gun will have an orifice which produces an 8 inch wide fan at distance of 1 foot from the orifice. Such a nozzle therefore has an included angle of the major diameter of the spray pattern of 36°. The vertical dimension of the pattern at 1 foot may be as small as 1½ inch thereby providing an included angle on the vertical or minor diameter of the pattern of approximately 7°.

It has been found that when using such prior art tips attached the normal manner by a tip guard from which the tip projects, that, in certain circumstances injection of human skin can occur up to 1 inch away from the orifice. Beyond 1 inch injection will not normally occur because the mass-velocity per unit area of the spray has diminished to a point below the rupture resistence or human flesh. Our invention therefore provides guard member 20 which extends outwardly beyond the nozzle orifice by a distance of approximately 1 inch and which will limit access to the area encompassed by the majority of the spray pattern thereby preventing user's finger or the like from coming into contact with the spray pattern within the critical area downstream of the nozzle.

Although I have described the dimension of the guard downstream of the nozzle as being approximately 1 inch, testing has shown that in controlled conditions injection will not occur 11/16 of an inch downstream of a nozzle when the fluid being sprayed is a normal oil base paint. However in order to provide a sufficient safety measure I prefer to provide a guard which extends at least 0.9 inches beyond the orifice and preferably approximately 1 inch. Testing to date has not shown a need for guard extending beyond 1 inch or, with a built-in safety margin beyond 1½ inch. Further, beyond that dimension it is believed that any effective tip guard would interfere with the spray pattern to an unreasonable extent. I would therefore define the operative dimensions of extension beyond the nozzle orifice for a tip guard of a design similar to that illustrated as being between ⅝ inch and 1½ inches.

However, I have found that in order to provide the greatest safety the tip guard must not only prevent accidential entry of large planar areas of flesh into the area downstream of the nozzle, but should also provide sufficient protection against intentional entry of smaller extremities, such as fingers, into that area. In order to accomplish this, it is desired to maintain the open end 30 of the tip guard with as small an entrance thereto as is practical. However, assuming an included angle on the major diameter of approximately 36°, the spray pattern will have a width of greater than 1 inch at 1½ inches downstream of the nozzle. At that same point the minor diameter will be only approximately 0.2 inch. If the tip guard were totally cylindrical, it would require a diameter at the open end 30 of greater than 1 inch in order to avoid interference with the spray pattern. An open end having a diameter of greater than 1 inch will alow entry of a finger thereinto and accidental activation of the spray pistol with a finger interior of the tip guard can still result in penetration.

However, it is also desired to provide a guard member having an internal dimension sufficient to not interfere with the spray pattern. This not only means that the inner dimension must be at least as large as the spray pattern but also, there must be a clearance factor because spray patterns are not abruptly defined and certain particles within the pattern will have a smaller velocity than other particles and may drift outside the major portion of the spray pattern.

In attempting to solve this problem I have determined that injection is not likely to occur where contact is with only a peripheral portion of the major diameter of the spray pattern. Edge portions of the major diameter of the spray pattern will not cause flesh injection even in an area relatively close to the nozzle. Therefore, providing a guard member that prevents contact with the periphery of the major diameter of the elongated oval spray pattern at a point relatively close to the nozzle while allowing contact with the periphery at a point prior to allowing contact with the entirety of the spray pattern will successfully eliminate the possibility of injection from occuring. This finding allows me to design the guard member with a circumferentially discontinuous wall having diametrically opposed axially extending slots aligned with the major diameter of the spray pattern. By doing this, I can maintain the dimension of the open end 30 relatively small so as to prevent entry of a finger thereinto while at the same time not interfering with the major diameter of the spray pattern by allowing the peripheries thereof to project through the slots to the exterior of the guard member.

As illustrated in Fig. 2, the tip guard 20 has a projecting portion 32 extending downstream of the nozzle tip 19 which has a circular cross-section. Slots 33 extend axially along the length of the cylinder of the guard member 20 from adjacent the nozzle orifice to the open end 30. The slots 33 are aligned with the tip 19 in such a manner that they are aligned with the major axis of the spray pattern from the orifice 21. The slots 33 have a circumferential dimension sufficient to receive the entire minor diameter of the spray pattern with clearance at the open 30 while at the same time preventing entry of a finger through the slots. The diameter of the cylindrical body of the guard member 20 is also maintained sufficiently small to restrict entry of a finger, in order to prevent entry of a finger while maintaining the inner diameter large enough to avoid spray pattern interference, I have provided a series of pointed ribs of 40 at the open end 30 which extend radially inwardly into the interior of the cylindrical portion 41 of the guard member 20. These ribs may extend the entire axial length to the nozzle orifice as illustrated in FIGS. 3 and 4 or may be located only adjacent the open end 30. The ribs have radial dimension sufficient to project inwardly to a point where entry of a small finger will be discouraged, while because they project in planes normal to the plane of the major diameter and parallel to the plane of the minor diameter, they will not interfere with the spray pattern.

As an example of a guard sufficient to prevent injection of human flesh by an airless paint spray pistol one has been constructed having the following dimensions: The cylindrical portion has an inner diameter of 0.59 inches and an outer diameter of 0.71 inches, with an axial length from the nozzle tip to the open end 30 of approximately 1 inch. The slots 33 have a open width of approximately 0.3 inches.

Assuming an included angle of the major diameter of the spray pattern of 36°, the peripheral portions of the major diameter of the spray pattern will not begin to enter the slots until approximately 0.9 inches downstream of the nozzle and since the minor diameter will be less than 0.2 inches at the open end 30 of a 1 inch long extension, the provision of 0.3 inch slot insure that there will be no interference with the spray pattern. Although the ribs may have a radial extension sufficient to provide a clearance therebetween which is equal to or slightly greater than the minor diameter of the spray pattern at the terminus end, I have found that they will adequately serve their function if they are maintained with a clearance of approximately ½inch. It is the primary purpose of the ribs to discourage intentional entry of a human finger into the open end 30 of the guard member. Although this can be accomplished by maintaining the inner clearance parallel to the minor diameter smaller than the diameter of the average small human finger and approximately the same as the minor diameter, to do so could interfere with the spray pattern. As has been pointed out previously, the spray pattern although generally having an oval shape with a major and a minor diameter, is not perfectly defined and a minor percentage of the spray exceeds the normal descriptive dimensions of the pattern. It is therefore desirable to provide a guard member with sufficient internal clearance to allow over pattern spray. In addition, a tightly encompassing guard member has a tunnel effect on the spray which can cause disruption of the spray pattern. It is not fully known why this occurs, however it is believed that the use of an enclosed sleeve tightly encompassing the spray pattern creates an air turbulence problem within the sleeve. In the above described embodiment, this air turbulence problem is not only eliminated, for the most part, because of the relatively large internal area of the guard member in comparison to its short axial length, but also because of the open slots. These slots while allowing the major diameter peripheries of the spray pattern to exit the guard member before the open end, also provide a free circulation of air into the interior of the guard member adjacent the nozzle.

FIGS. 3 and 4 also illustrate another major criterion of this invention. In both instances, the nozzle tip 19 has an enlarged diameter porton 50 at the inner axial end 51. This enlarged diameter portion provides a radial ledge 52 which is used to attach the nozzle to the externally threaded tubular member 23 projecting from the body member 11. A washer 53 is normally interposed between the end 23A and the end 51. Normally the ledge 52 is abutted by the inturned lip 18A of the tip nut 18 and the lip 18A normally has an inner diameter less that the diameter of the ledge 52 to provide an axial overlap. In the construction illustrated, I have provided a tip nut which has an inturned lip having an inner diameter clearance greater than the outer diameter of the ledge 52. In this manner, the tip nut can not maintain the nozzle tip in positon at the end of the tubular member 23. Instead the nozzle tip is maintained in position by abutting the ledge 52 against a ledge 55 formed on the inner diameter of the guard member 20. The guard member then has a further spaced radially outwardly extending ledge member 56 which abuts the inturned lip 18A. Thus the tip nut holds the guard member in axial position at the end of the spray pistol body 11 while the guard member holds the nozzle tip in place. In this manner, I have assured that the spray gun cannot be operated without the guard member 20 in place. Any attempt to so operate it would fail because of the inability of the nozzle tip to be affixed to the end of the spray pistol body 11.

In the illustrated embodiment, this feature is easily provided by making the tip nut 18 longer than the prior art tip nuts thus spacing the inturned lip 18A further from the end 23A of the tubular member 23 a distance sufficient to accomodate the added axial length between the guard member ledges 55 and 56. The increase in the inner diameter of the tip nut can be accomodated either by increasing the outer diameter of the threaded portion 23 as illustrated in FIG. 4 or by interposing a sleeve 60 which has both inner and outer diameter threads intermediate the tip nut 18 and the tubular member 23.

While it is also possible to provide a varying inner diameter tip nut which has an axial portion for engaging the tubular member with a reduced inner diameter and an outer axial end portion with a larger inner diameter for receiving the guard member, it is believed the embodiments illustrated in FIGS. 3 and 4 are superior to such a construction in that they allow a full axial adjustment of the tip nut thereby allowing the use of a large variety of nozzle tips and guard members.

It is to be appreciated that the ledge 56 on the outer diameter of the tip nut is generated as a circle as is the inturned ledge 18A. This allows complete rotation of the guard member with respect to the tip nut. However, the inner diameter 62 of the guard member which abuts the outer diameter 63 of the nozzle tip has diametrically opposed flats 64 thereon which mate with flats 65 on the nozzle tip. In this manner the nozzle tip is not rotatable independently of the guard member. This serves to align the slots 33 with the peripheral portions of the major diameter of the spray pattern exiting the nozzle orifice 21 while, at the same time, allowing the nozzle to be rotated with respect to the spray pistol body 11 by rotation of the guard member 20. This rotation is desirable in that it is often times advantageous to change the orientation of the major diameter of the spray pattern with respect to the pistol body.

It can therefore be seen from the above that my invention provides a safety tip assembly for airless paint spray pistols which incorporates an axially extending guard member which projects beyond the nozzle orifice a distance sufficient to prevent injection of human flesh by spray from the orifice. The guard member has an internal diameter less than the major diameter of the pattern of spray orifice through a portion of the axial length of the guard member, the guard member being equipped with axially extending slots therethrough for receipt of the peripheral portions of the major diameter. The nozzle tip is concentrically received within the guard member adjacent one axial end thereof, and the guard member is concentrically received within an attachment tip nut and affixed to the spray pistol body thereby along. Means preventing the attachment of the nozzle tip to the spray pistol body by the tip nut without the guard member in place are provided.

Although the teachings of my invention have herein been discussed with reference to specific theories and embodiments, it is to be understood that these are by way of illustration only and that others may wish to utilize my invention in different designs or applications.

I claim as my invention:

1. A spray pistol which comprises a body having an externally threaded tubular projection receiving therethrough from the body, material to be sprayed, a nozzle tip with a spray pattern defining orifice overlying the outboard of said tubular projection, a seal between said tip and said projection, a tubular guard surrounding the inboard end of said nozzle tip and projecting therefrom to a free end substantially downstream from said orifice, a tip nut embracing the inboard end of said guard and threaded on said tubular projection for pressing said guard against said tip and said tip and seal against said tubular projection, and overlapping ledge and flange abutments between the tip and guard and the guard and tip nut with clearance between the tip and tip nut ledge and flange whereby said nozzle tip and seal will not be pressed against said projection unless said guard is in position around said nozzle tip.

2. A spray pistol for airless spraying having a pistolike body with internal passageways porting pumped fluid from a passage inlet to a nozzle outlet, a trigger controlled valve in said passageway controlling the flow of fluid therethrough, the nozzle comprising a nozzle tip asssembly including an orifice defining member closing said passageway with a slot orifice therethrough, the nozzle tip assembly attached to the body by a tip nut having a threaded bore therethrough engaging a threaded passageway defining portion of the pistol, the bore having a reduced inner diameter end portion, a guard member having an elongated hollow body with an enlarged outer diameter end porton, the guard member received interior of said nut and projecting from an open end thereof, terminating in a free end, the enlarged end portion of the guard member retained in the tip nut by the reduced inner diameter of the tip nut, the nozzle tip assembly received interior of the guard member adjacent the enlarged end portion with the orifice discharging interiorly of the projecting portion guard member towards the free end, overlapping flange means between the tip assembly and the guard limiting axial movement of the nozzle tip assembly towards the free end, face mating means restricting rotational movement of the holder member within the guard, the gurad member projecting beyond the orifice a distance greater than approximately ⅝ inch and sufficient to prevent injection of human flesh by the discharge from the orifice when the flesh is located at the free end, the overlapping flange means and the reduced inner diameter end of the tip nut being dimensioned such that the tip assembly is held on the pistol by the tip nut only when the guard is interposed between the tip assembly and the tip nut.

3. The improvement of claim 2 wherein the orifice has a noncircular cross-section discharge pattern, the guard member has an internal dimension downstream of the orifice aligned with the major diameter which is less than the major diameter of the pattern, the hollow body having a discontinuous wall downstream of the nozzle providing opposed axially extending slots aligned with the major diameter through which peripheral portions of the pattern project.

* * * * *